US008348698B2

(12) United States Patent
Homma et al.

(10) Patent No.: US 8,348,698 B2
(45) Date of Patent: Jan. 8, 2013

(54) FUEL SUPPLY DEVICE

(75) Inventors: Bunji Homma, Kiryu (JP); Takao Ikarugi, Kiryu (JP); Taichi Nakamura, Kiryu (JP); Yasunori Fukushima, Kiryu (JP); Takeshi Yanagisawa, Wako (JP); Masayuki Toriyama, Wako (JP); Naoyuki Yamate, Wako (JP)

(73) Assignees: Mitsuba Corporation, Gunma (JP); Honda Motor Co., Ltd., Tokyo (JP)

( * ) Notice: Subject to any disclaimer, the term of this patent is extended or adjusted under 35 U.S.C. 154(b) by 456 days.

(21) Appl. No.: 12/711,405

(22) Filed: Feb. 24, 2010

(65) Prior Publication Data

US 2010/0215523 A1 Aug. 26, 2010

(30) Foreign Application Priority Data

Feb. 26, 2009 (JP) ..... 2009-43720

(51) Int. Cl.
*H01R 13/40* (2006.01)

(52) U.S. Cl. ..... 439/589; 439/271; 439/281; 439/891

(58) Field of Classification Search ..... 439/271, 439/281, 587, 589, 692, 891
See application file for complete search history.

(56) References Cited

U.S. PATENT DOCUMENTS 4,961,018 A * 10/1990 Akhter ..... 310/87
7,854,629 B1 * 12/2010 Albers et al. ..... 439/589
8,029,317 B2 * 10/2011 Albers et al. ..... 439/589
2010/0178180 A1 * 7/2010 Homma et al. ..... 417/422
2010/0215523 A1 * 8/2010 Homma et al. ..... 417/410.1
2011/0142697 A1 * 6/2011 Petrucci ..... 417/422
2011/0176941 A1 * 7/2011 Albers et al. ..... 417/410.1

FOREIGN PATENT DOCUMENTS

JP 2002-285931 10/2002
JP 2003-201932 7/2003
JP 2007-270627 10/2007

* cited by examiner

*Primary Examiner* — James Harvey

(74) *Attorney, Agent, or Firm* — Wenderoth, Lind & Ponack, L.L.P.

(57) ABSTRACT

Male terminals are respectively provided in terminal attachment portions formed on a flange unit. Female terminals and grommets are provided for a harness. A seal lip portion to be fitted into each of the terminal attachment portions is formed on each of the grommets. In the cylindrical terminal attachment portions the male terminals are individually accommodated while being electrically insulated from each other. The terminal attachment portions are arranged alternately in two rows so that a line segment obtained by connecting the respective centers of openings of the terminal attachment portions is a polygonal line. The openings are arranged to form the Olympic symbol. At a fore-end of each of the terminal attachment portions, slits are provided. Owing to the slits, the opening is likely to be enlarged when the rubber grommet is inserted therethrough. As a result, the placement of the rubber grommet is facilitated.

8 Claims, 8 Drawing Sheets

FUEL SUPPLY DEVICE

BACKGROUND OF THE INVENTION

1. Field of the Invention

The present invention relates to a fuel supply device for a vehicle, which uses an electric pump device, in particular, a structure of a terminal connection portion of a wiring for feeding power to a motor, in a fuel supply device for a two-wheel motor vehicle.

2. Description of the Related Art

In recent years, a fuel pump module obtained by integrating a fuel pump, a pressure controller, a strainer, and the like is widely used as a fuel supply device for vehicles such as two-wheel and four-wheel vehicles, in view of the reduction of the number of components, the improvement of efficiency of an assembly operation, and the like. In the fuel pump module, an electric pump device (hereinafter, referred to simply as an "electric pump" as needed) driven by an electric motor is used as the fuel pump. The fuel pump is unitized together with the motor for driving the fuel pump and the like to be provided in a fuel tank or in the vicinity thereof.

In the fuel supply device, the pump module is formed by fixing the electric pump, the strainer, a pressure regulator, and the like onto a disc-like member called a flange. The flange is mounted onto an opening of the fuel tank. As a result, the pump module, i.e., the fuel supply device is placed in the fuel tank. When the electric pump is driven, a fuel in the fuel tank is sucked into the fuel supply device through a filter. After being strained by the strainer and subjected to pressure control by the pressure controller or the like, the sucked fuel is supplied to a fuel supply system of an engine.

On the other hand, in the fuel supply device as described above, a wire harness for connecting power-feeding terminals provided to the flange and the pump module to each other is provided as feeder wirings for feeding electric power to the electric pump. The power-feeding terminals on the flange side are electrically connected to external supply terminals which are connected to a power supply such as an on-vehicle battery. Electric power used for driving is fed from the power-feeding terminals to the electric pump through the wire harness. Male terminals are provided inside the flange as the power-feeding terminals. The wire harness is connected to the male terminals so that female terminals provided to a fore-end of the wire harness are respectively fitted to the male terminals.

FIGS. 8 and 9 are explanatory views, each illustrating a structure of the power-feeding terminals provided on the flange side in the electric pump. As illustrated in FIG. 8, a flange 101 includes cylindrical terminal attachment portions 102 which are formed thereon. In a bottom portion of each of the terminal attachment portions 102, a male terminal 103 is accommodated, as illustrated in FIG. 9. The male terminals 103 are electrically insulated from each other by the cylindrical case-like terminal attachment portions 102. Female terminals 105 provided to a fore-end of a wire harness 104 are respectively connected to the male terminals 103. When the female terminals 105 are respectively inserted into the terminal attachment portion 102 to be fitted to the male terminals 103 provided in the bottom portions of the terminal attachment portions 102, the wire harness 104 is connected to a power supply.

A rubber grommet 106 is provided to each of the female terminals 105 on the wire harness 104 side. When each of the female terminals 105 is fitted to the corresponding male terminal 103 to be connected thereto, the rubber grommet 106 is inserted into the terminal attachment portion 102. The female terminal 105 is connected to the male terminal 103 present in the terminal attachment portion 102 while being retained by the rubber grommet 106. The terminal attachment portion 102 is sealed by the rubber grommet 106. A portion at which the male terminal 103 and the female terminal 105 are connected to each other is sealed by the rubber grommet 106 without being externally exposed. In a lower part of the flange 101, a coupler attachment portion 107 is provided. One end of each of the male terminals 103 is provided as a supply terminal 108 inside the coupler attachment portion 107. The supply terminals 108 are arranged in a row in the coupler attachment portion 107 so as to conform to the specifications of a coupler.

In the conventional fuel supply device as illustrated in FIGS. 8 and 9, however, intervals at which the supply terminals 108 are arranged are predetermined according to the specifications of the coupler. Therefore, if the male terminals 103 are arranged according to the intervals at which the supply terminals 108 are arranged, a space for locating the terminal attachment portions 102 therein becomes small because each of the intervals between the terminals of the coupler is small. As a result, all the cylindrical terminal attachment portions 102 cannot be located in the space. On the other hand, if each of the terminal attachment portions 102 is formed to have the cylindrical case-like shape to provide partitions for sealing between the male terminals 103 as illustrated in FIG. 8, the number of terminals which can be located in the terminal attachment portions 102 is limited. For example, even when a five-pin coupler is used, a space for only four terminals is ensured on the side of the terminal attachment portions 102. Thus, one of the terminals of the coupler cannot be used. Moreover, one end of a metal member used for each of the supply terminals 108 is arranged according to the specifications of the coupler. On the other hand, another end of the metal member is located as the male terminal 103 in each of the terminal attachment portions 102. Therefore, the metal member used for the terminal has a different shape for each of the terminals, and hence four metal terminal members are disadvantageously required for each device.

Further, in the case of the structure illustrated in FIGS. 8 and 9, a distance between the terminal attachment portions 102 is reduced in response to a requirement of the reduction of size of the device or the like. If the terminal attachment portions 102 are close to each other, it becomes difficult to insert the rubber grommet 106 into the corresponding terminal attachment portion 102. Therefore, it is difficult to connect the male terminal 103 and the female terminal 105 to each other. However, the space for locating the terminal attachment portions 102 is limited, and hence a large tapered portion cannot be formed over an opening portion of each of the terminal attachment portions 102. In view of such problems, measures to further facilitate an operation of inserting the grommet have been requested.

SUMMARY OF THE INVENTION

The present invention has an object of efficiently arranging terminals in a limited space while ensuring sealability in a wire-harness connecting portion of a fuel supply device. The present invention has another object of improving the easiness of placement of a grommet in a sealing structure using the grommet.

A fuel supply device according to an aspect of the present invention includes: an electric pump device driven by an electric motor; and a case member for housing and retaining the electric pump device therein, and is characterized in that: the case member includes a plurality of terminal attachment portions, in which a plurality of power-feeding terminals to be connected to feeder wirings of the electric motor are individually accommodated while being electrically insulated from each other; and the plurality of terminal attachment portions are arranged alternately in two rows so that one of the plurality of terminal attachment portions in one of the two rows is located between the terminal attachment portions which are adjacent to each other in another row.

According to the aspect of the present invention, the terminal attachment portions are arranged alternately in two rows. As a result, a larger number of the terminal attachment portions can be arranged in a space having the same length as that of a conventional space. Moreover, an interval between the terminal attachment portions which are adjacent to each other in the same row can be increased as compared with a conventional one. Therefore, it becomes easy to insert the rubber grommet provided to the feeder wiring into the terminal attachment portion. Further, the number of types of the terminal members used as the power-feeding terminals can be reduced to two.

In the fuel supply device, each of the plurality of terminal attachment portions may be formed to have a cylindrical shape so that the plurality of terminal attachment portions may respectively accommodate the plurality of power-feeding terminals therein, and a line segment obtained by connecting centers of openings of the plurality of terminal attachment portions adjacent to one another may be a polygonal line. Further, each of the plurality of power-feeding terminals may be formed by a terminal member made of a metal, having one end connected to each of the feeder wirings and another end connected to a coupler electrically connected to an external power supply. The terminal member may be configured to include two types of components including a component provided for the terminal attachment portion arranged in the one row of the plurality of terminal attachment portions arranged alternately in the two rows and a component provided for the terminal attachment portion arranged in the another row of the plurality of terminal attachment portions arranged alternately in the two rows.

At a fore-end of each of the terminal attachment portions, a slit which allows to elastically enlarge the opening of the terminal attachment portion may be provided. In this manner, when the rubber grommet provided to a portion, at which the power-feeding terminal and the feeder wiring are coupled, is to be inserted into the opening, an outer edge of the opening may be elastically enlarged owing to the slit to facilitate an operation of inserting the rubber grommet.

The rubber grommet is provided to the portion at which the power-feeding terminal and the feeder wiring are coupled, and a seal lip portion having a plurality of successively arranged concave portions and convex portions may be provided on an outer periphery of the rubber grommet. In addition, a point angle θ of each of the plurality of convex portions may be formed to be obtuse so as to easily remove the rubber grommet from a die at the time of molding. Moreover, a fluororubber having a high oil resistance may be used for the rubber grommet.

Further, the fuel supply device may be used for a fuel obtained by mixing alcohol such as ethanol and gasoline in an arbitrary proportion.

On the other hand, a fuel supply device according to another aspect of the present invention includes: an electric pump device driven by an electric motor; and a case member for housing and retaining the electric pump device therein, and is characterized in that: the case member includes a plurality of terminal attachment portions, in which a plurality of power-feeding terminals to be connected to feeder wirings of the electric motor are individually accommodated while being electrically insulated from each other; and each of the plurality of terminal attachment portions has a slit which allows to elastically enlarge an opening of each of the plurality of terminal attachment portions, at a fore-end thereof. As a result, for placing the feeder wiring in the terminal attachment portion, the insertion of the rubber grommet provided to the feeder wiring into the terminal attachment portion can be facilitated.

DETAILED DESCRIPTION OF THE PREFERRED EMBODIMENTS

Figure 1:
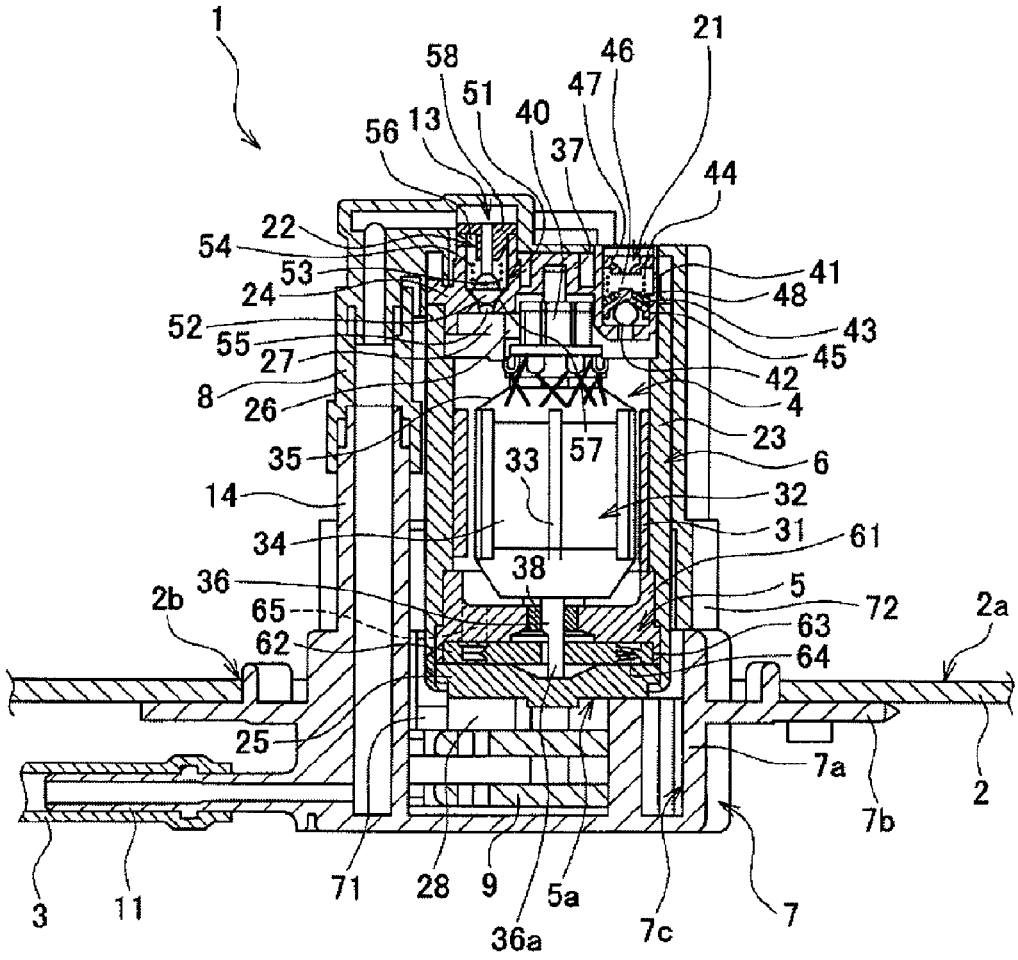
FIG. 1 is a sectional view illustrating a structure of a fuel supply device using an electric pump device, corresponding to an embodiment of the present invention.

Hereinafter, exemplary embodiments of the present invention are described in detail with reference to the accompanying drawings. FIG. 1 is a sectional view illustrating a structure of a fuel supply device using an electric pump device, which corresponds to an embodiment of the present invention. A fuel supply device 1 illustrated in FIG. 1 is a device for a two-wheel motor vehicle. A fuel tank 2 stores a fuel obtained by mixing alcohol and gasoline in an arbitrary proportion. The fuel supply device 1 is mounted to the fuel tank 2 by being inserted upward from a bottom of the fuel tank 2. The fuel supply device 1 is connected to a fuel supply system (not shown) of an engine to supply the fuel to a fuel injection valve of the engine through a fuel pipe 3.

The fuel supply device 1 includes a pump assembly (electric pump device) 6 obtained by integrating an electric motor 4, a fuel pump (pump) 5, and the like. The pump assembly 6 is housed in a flange unit (case member) 7. An upper cup 8 is mounted onto the pump assembly 6 housed in the flange unit 7. In the pump assembly 6, the fuel pump 5 is provided on the side of one end of the electric motor 4. On the side of another end of the electric motor 4, an outlet cover (cover member) 24 including a pressure regulator 21 for regulating a fuel pressure and a check valve 22 for preventing a backflow of the fuel is provided.

Figure 2:
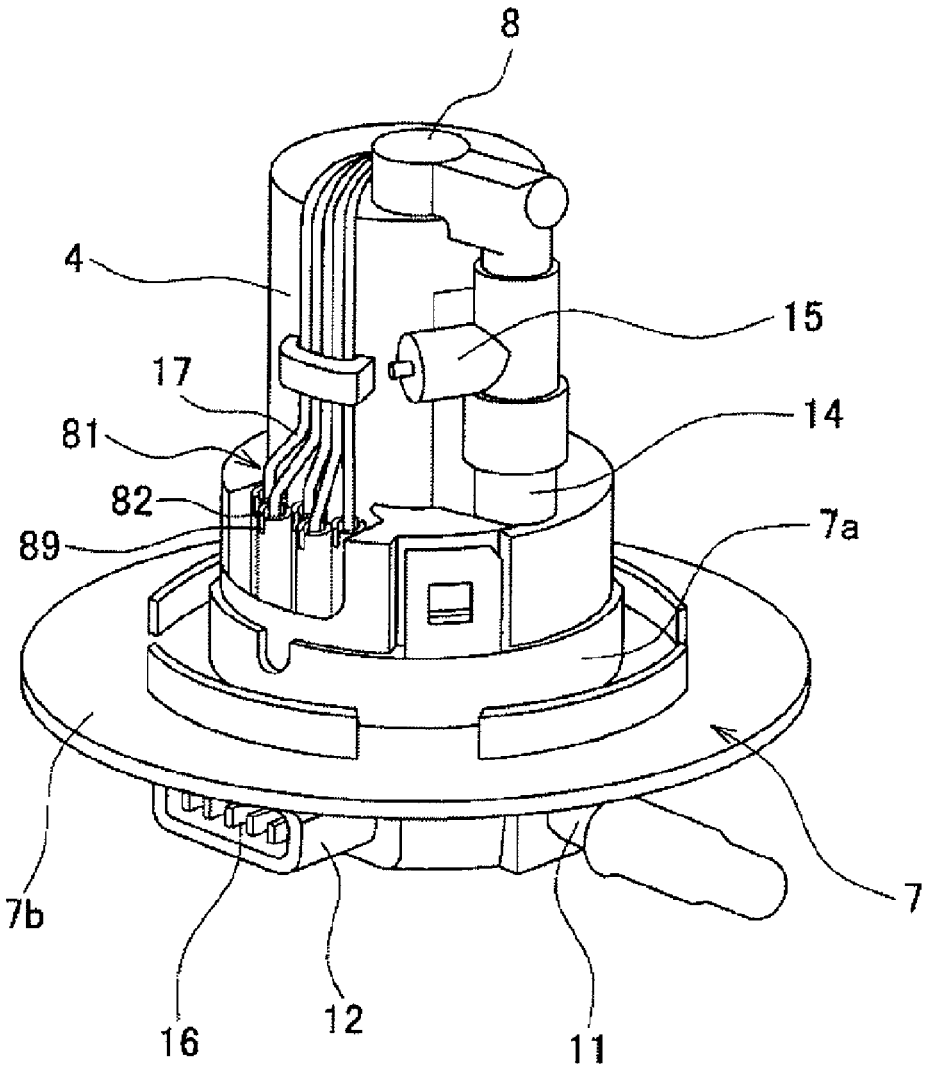
FIG. 2 is a perspective view illustrating a state where a pump assembly is mounted into a flange unit and an upper cup is mounted onto the pump assembly.

The flange unit 7 includes a cylindrical case portion 7*a* and a flange portion 7*b*. Inside the case portion 7*a*, a filter 9 is provided. The pump assembly 6 is located above the pump assembly 6. FIG. 2 is a perspective view illustrating a state where the pump assembly 6 is mounted into the flange unit 7 and the upper cup 8 is mounted onto the pump assembly 6. In the state illustrated in FIG. 2, the fuel supply device 1 is inserted into the fuel tank 2 through a pump attachment hole 2*b* which is formed through a bottom surface 2*a* of the fuel tank 2. For mounting the fuel supply device 1 into the fuel tank 2, the flange portion 7*b* is fixed to the bottom of the fuel tank 2 by a bolt and a nut (not shown).

An outlet pipe 11 and a power connector 12 are provided to a lower end of the flange unit 7. The fuel pipe 3 is connected to the outlet pipe 11. The outlet pipe 11 is connected to a fuel discharge port 13 of the pump assembly 6 through an intermediation of a communication pipe 14. A relief valve 15 for regulating the fuel pressure in the fuel pipe 3 is provided to the communication pipe 14. Supply terminals 16 are provided inside the power connector 12. The supply terminals 16 are connected to a harness (a set of feeder wirings) 17 at a terminal connection portion 81. The harness 17 extends upward on the lateral side of the pump assembly 6 to be electrically connected to the electric motor 4 at the upper end of the pump assembly 6.

Figure 3:
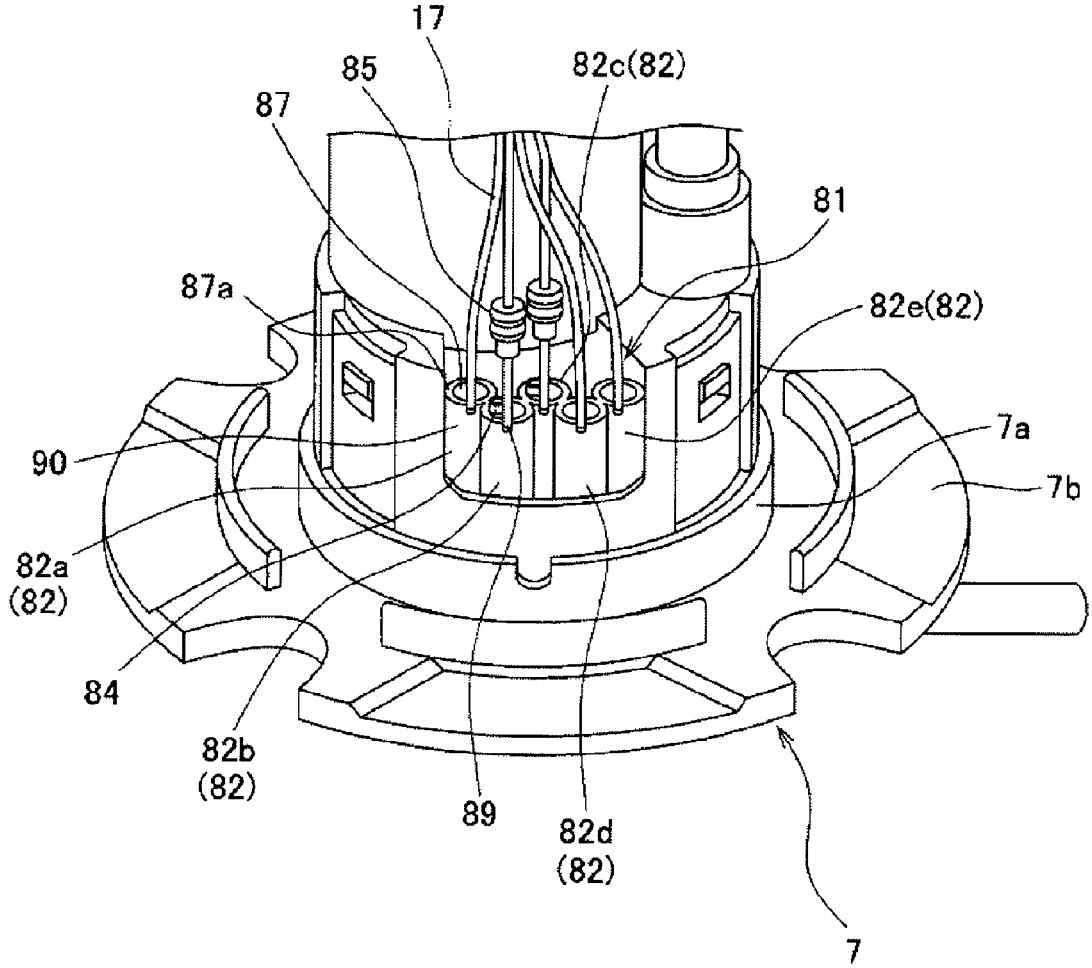
FIG. 3 is an explanatory view illustrating a structure of a terminal connection portion.
Figure 4:
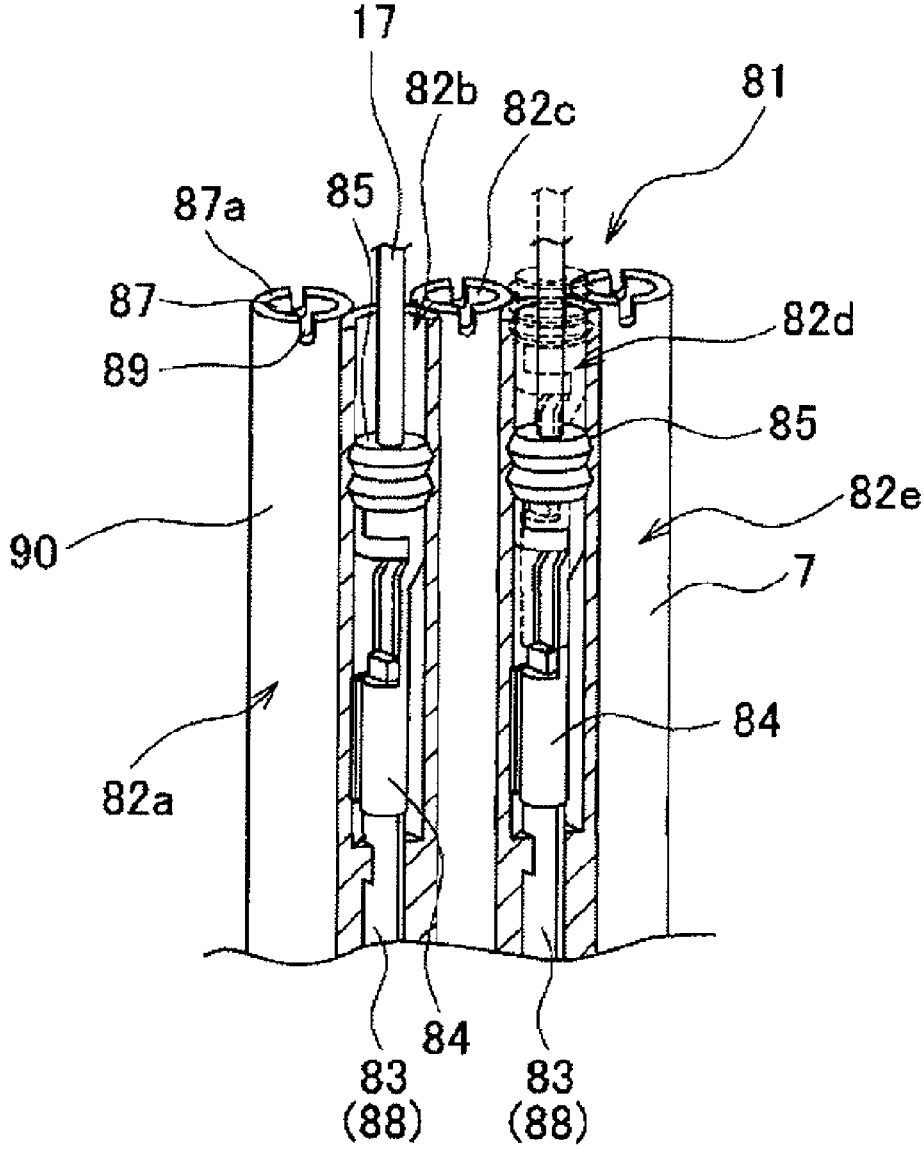
FIG. 4 is an explanatory view illustrating a sectional structure of the terminal connection portion.

FIGS. 3 and 4 are explanatory views, each illustrating a structure of a terminal connection portion 81. As illustrated in FIG. 3, the flange unit 7 includes cylindrical terminal attachment portions 82 formed thereon, each extending in a vertical direction in FIG. 1. In a bottom portion of each of the terminal attachment portions 82, as illustrated in FIG. 4, a male terminal (power-feeding terminal) 83 is accommodated. The male terminals 83 are electrically connected to the supply terminals 16, respectively. For each set of the male terminal 83 and the supply terminal 16, a terminal plate (terminal member) 88 made of a metal is used. One end of the terminal plate 88 serves as the male terminal 83, whereas another end thereof serves as the supply terminal 16. The male terminals 83 are respectively placed in the corresponding terminal attachment portions 82 while being electrically insulated from each other by outer walls 90 of the terminal attachment portions 82.

Figure 5A:
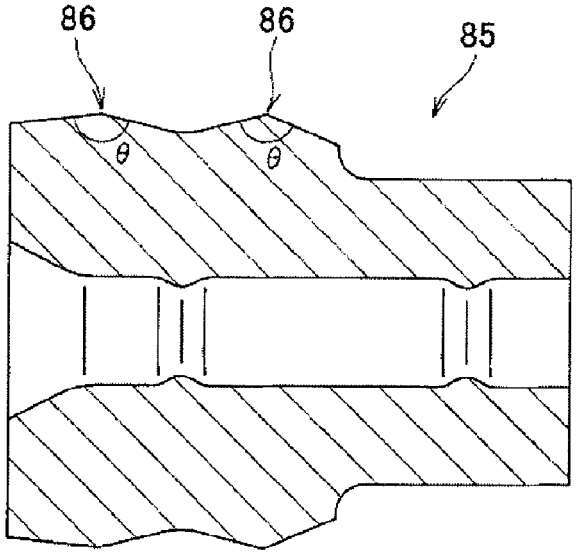
FIG. 5A is a sectional view illustrating a structure of a rubber grommet used in the electric pump device illustrated in FIG. 1.

On the other hand, female terminals 84 are provided at a fore-end of the harness 17. Even in the fuel supply device 1, the female terminals 84 are inserted into the terminal attachment portions 82 to be fitted to the male terminals 83 placed in the bottom portions of the terminal attachment portions 82. As a result, the harness 17 is electrically connected to the supply terminals 16. A rubber grommet 85 is provided to a portion at which each feeder wiring of the harness 17 and a corresponding one of the female terminals 84 are coupled. FIG. 5A is a sectional view illustrating a structure of the rubber grommet 85. As illustrated in FIG. 5A, on an outer periphery of the rubber grommet 85, a seal lip portion 86 having a plurality of successively arranged concave portions and convex portions is formed. When the female terminal 84 is fitted to the male terminal 83 to be connected thereto, the rubber grommet 85 is inserted into the terminal attachment portion 82 to bring the seal lip portion 86 into close contact with an inner wall of the terminal attachment portion 82. When the rubber grommet 85 is placed in the terminal attachment portion 82, the female terminal 84 is connected to the male terminal 83 in the terminal attachment portion 82 while being retained by the rubber grommet 85.

Figure 5B:
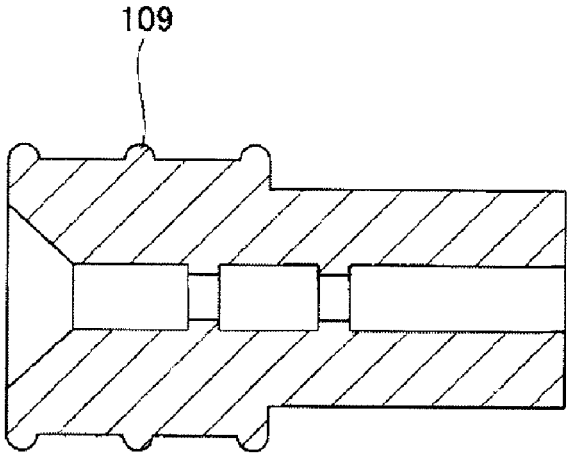
FIG. 5B is a sectional view illustrating a conventional rubber grommet.

Each of the convex portions of the seal lip portion 86 of the rubber grommet 85 used in the fuel supply device 1 has an obtuse point angle θ. In a water-proof coupler used in an atmosphere, nitrile butadiene rubber (NBR), silicon, or the like is conventionally used as a material of the grommet used for sealing. However, if the grommet is used in a liquid, in particular, in gasoline containing alcohol, there is a problem in that silicon greatly swells and NBR swells at a high alcohol concentration. On the other hand, if a fluororubber having an oil resistance is used as a material of the grommet, the problem of swelling does not occur. When the fluororubber is used, however, it is difficult to remove the rubber grommet at the time of molding with a conventional grommet structure having a seal lip portion 109 with projections as illustrated in FIG. 5B. Therefore, a molding die is inevitably required to be formed as a split mold. As a result, a parting line is disadvantageously generated on a sealing surface, and hence there is a fear in that sealability may be lowered.

In view of the problem described above, in the fuel supply device 1, each of the convex portions of the seal lip portion 86 is formed to have an obtuse point angle. In this manner, even when the fluororubber is used for the grommet, the rubber grommet 85 can be removed from (axially pulled out of) the die at the time of molding. As a result, the parting line is not generated on the sealing surface of the rubber grommet. Thus, the fluororubber having a high oil resistance can be used as the material of the rubber grommet without lowering the sealability. Moreover, the convex portion of the seal lip portion 86 is formed to have the obtuse point angle, and hence a length of a sealing area provided by the rubber grommet 85 can be increased after the rubber grommet 85 is inserted into the terminal attachment portion 82. As a result, the reliability of sealing can be improved. An opening 87 of the terminal attachment portion 82 is closed by the rubber grommet 85 to achieve a hermetically-sealed state. The terminals 83 and 84 are sealed in the terminal attachment portion 82 in an insulated state without being externally exposed.

Figure 6A:
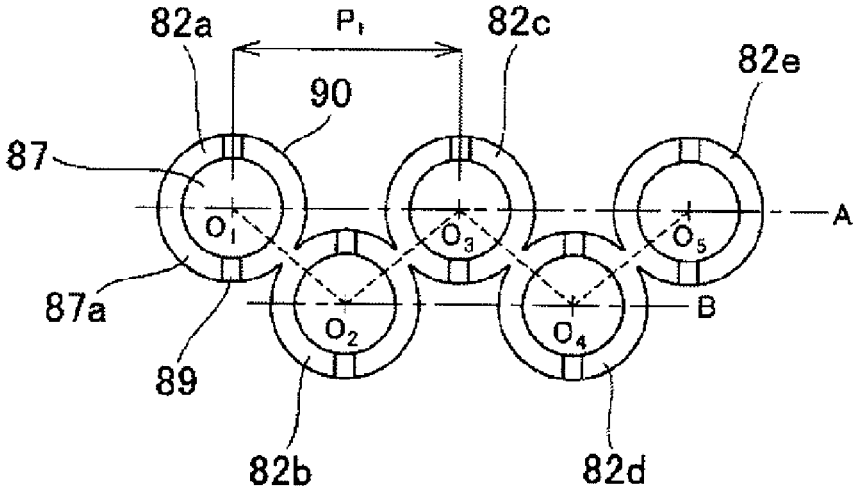
FIG. 6A is an explanatory view illustrating a state where terminal attachment portions are arranged in the fuel supply device according to the present invention.

On the other hand, in the fuel supply device 1, the terminal attachment portions 82 are arranged alternately in two rows, as illustrated in FIG. 3. FIG. 6A is an explanatory view illustrating a state where the terminal attachment portions 82 are arranged in the fuel supply device 1 according to the present invention. As illustrated in FIG. 6A, the terminal attachment portions 82*a* to 82*e* are arranged in two rows (rows A and B). The terminal attachment portions 82 are arranged alternately in the two rows, i.e., in a zigzag manner so that one of the terminal attachment portions 82 in one of the rows is located between the terminal attachment portions 82 which are adjacent to each other in another row. Specifically, for example, the terminal attachment portion 82*b* arranged in the row B, which is adjacent to the terminal attachment portion 82*a* in the another row A, is located between the terminal attachment portions 82*a* and 82*c* adjacent to each other in the row A. Therefore, a line segment obtained by connecting respective centers $O_1$ to $O_5$ of openings of the terminal attachment portions 82*a* to 82*e* which are adjacent to one another is a polygonal line. The number of the terminal attachment portions 82 is five in this case, and hence a W-shaped line segment is created by connecting the centers $O_1$ to $O_5$. Moreover, as viewed as a whole, the openings 87 of the terminal attachment portions 82 are arranged to look like the Olympic symbol.

By arranging the terminal attachment portions 82 alternately in the two rows, a larger number of the terminal attachment portions 82 can be located in a space having the same length as that of a conventional space. Specifically, if the terminal attachment portions are arranged in one straight row as in a conventional fuel supply device illustrated in FIG. 6B, only four terminal attachment portions can be located due to the spatial restriction. On the other hand, according to the present invention, the number of the terminal attachment portions which can be located in the same space is increased to five as illustrated in FIG. 3. Therefore, even when a five-pin coupler is used, there is no unavailable pin as in the case of the conventional fuel supply device. Therefore, the degree of freedom in the arrangement of the supply terminals 16 can be increased. Thus, even if there are limits in the space in which the fuel supply device is provided or the specifications of the coupler, the terminal attachment portions 82 can be designed in accordance with the coupler without impairing the sealing functions and insulating performance of the portion at which the terminals are connected to the harness 17.

Figure 6B:
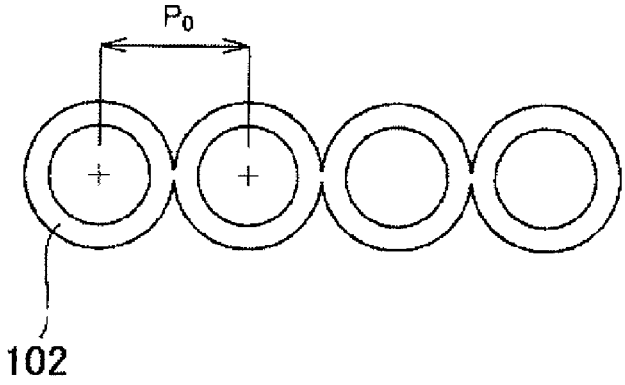
FIG. 6B is an explanatory view illustrating a state where the terminal attachment portions are arranged in a conventional fuel supply device.

Moreover, an interval between the terminal attachment portions 82 which are adjacent to each other in the same row (distance between the centers O of the openings) can also be increased as compared with a conventional interval (conventional interval $P_0$, and interval $P_1$ in the present invention; see FIGS. 6A and 6B). Therefore, the operability of the operation of inserting the grommet can be improved while the requirement of the reduction of the size of the device is satisfied. In the fuel supply device 1, slits 89 are provided at the fore-end of each of the terminal attachment portions 82. Owing to the slits 89, an outer edge 87*a* of the opening 87 can be elastically enlarged when the rubber grommet 85 is inserted into the terminal attachment portion 82. The elastically enlarged outer edge 87*a* of the opening 87 further facilitates the operation of inserting the grommet as compared with that in the conventional device. In addition to the effects of the increased interval between the centers of the openings, the operability in the placement of the grommet is greatly improved in the fuel supply device 1.

Figure 7:
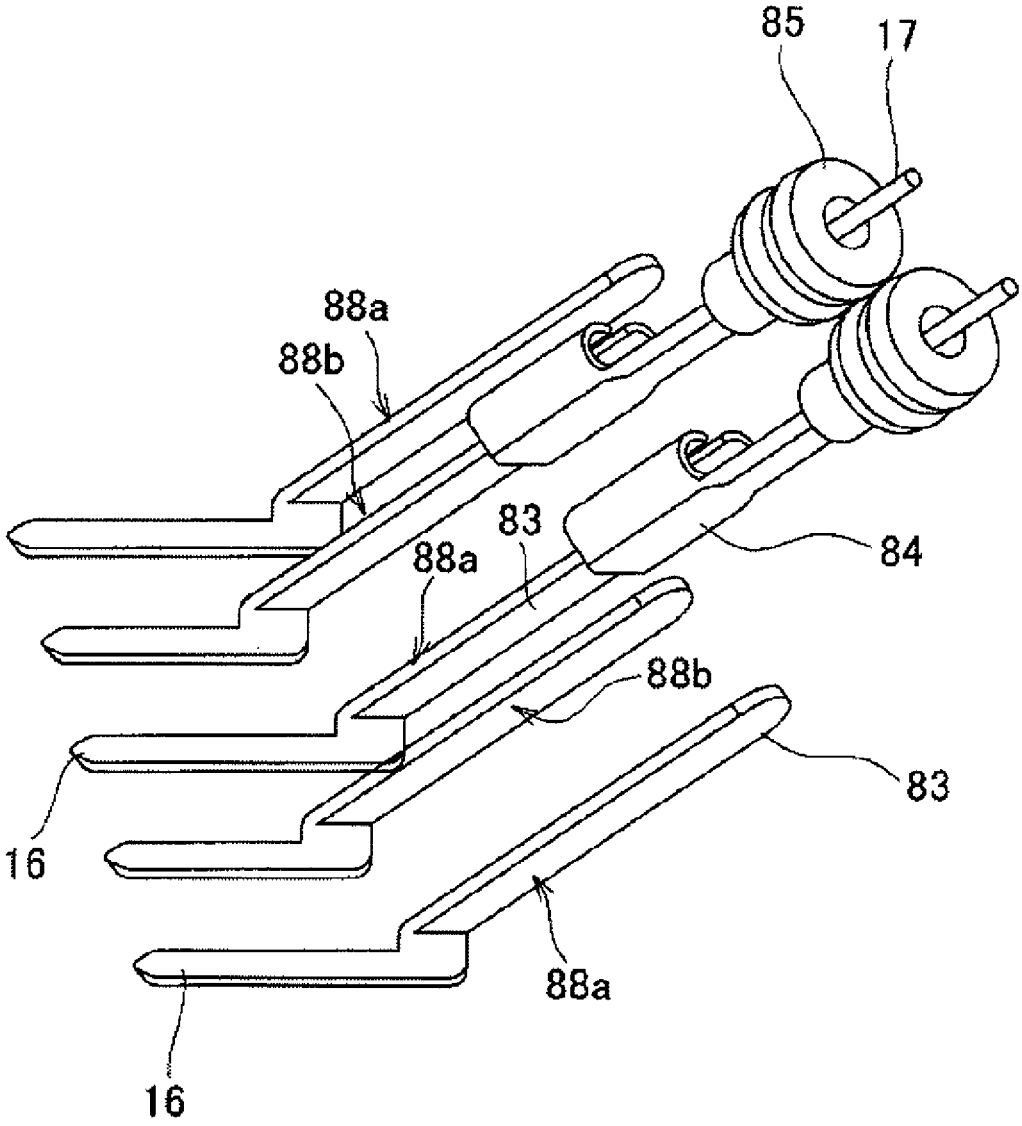
FIG. 7 is an explanatory view illustrating structures of terminal plates.
Figure 8:
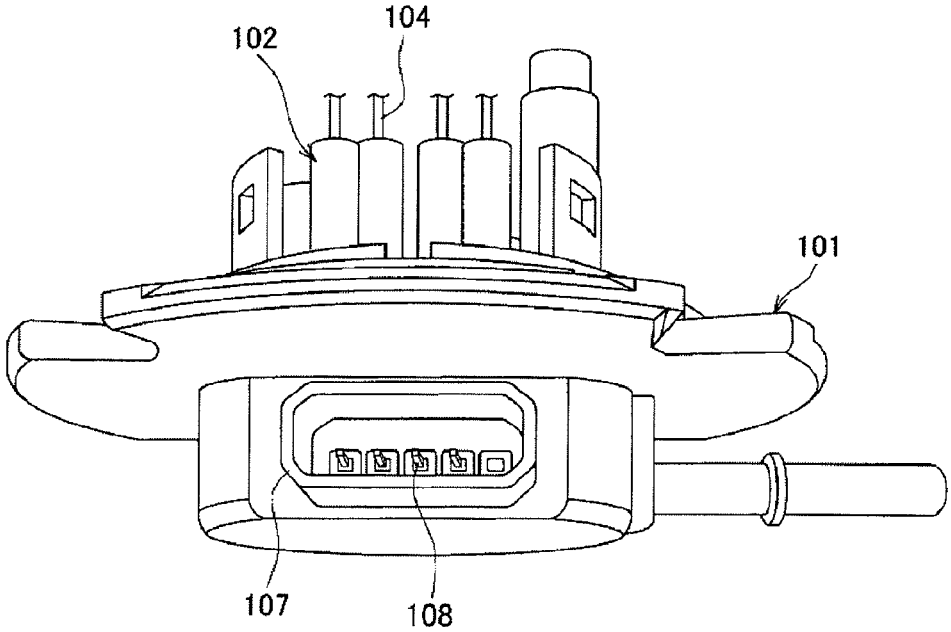
FIG. 8 is an explanatory view illustrating a structure of a conventional terminal connection portion.
Figure 9:
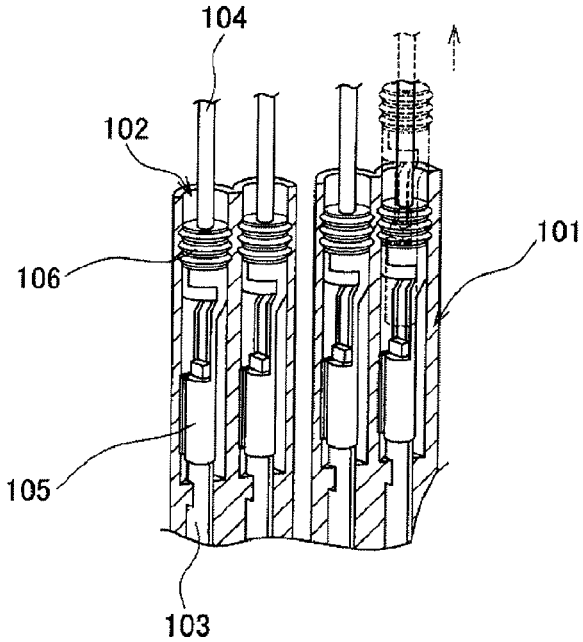
FIG. 9 is an explanatory view illustrating a sectional structure of the conventional terminal connection portion.

Further, the number of types of the terminal plates 88 can be reduced to two in the fuel supply device 1 of the present invention. FIG. 7 is an explanatory view illustrating structures of the terminal plates 88. As described above, four types of components are required as the terminal plates in the conventional fuel supply device. Thus, the conventional fuel supply device is disadvantageous in the increased number of components and the lowered operability in the placement. In the fuel supply device 1 of the present invention, the number of types of the components can be reduced to two, that is, terminal plates 88*a* (three in number) respectively corresponding to the terminal attachment portions 82*a*, 82*c*, and 82*e* in the row on the rear side and terminal plates 88*b* (two in number) respectively corresponding to the terminal attachment portions 82*b* and 82*d* in the row on the front side. Thus, as compared with the conventional fuel supply device, the number of components can be reduced to reduce product cost. Further, the operability at the time of placement is improved. As a result, the number of fabrication steps is reduced to reduce erroneous placement.

In the flange unit 7, a bottom portion of the case portion 7*a* serves as a reservoir portion 71. The reservoir portion 71 is placed below the bottom surface 2*a* of the fuel tank 2. A fuel inlet hole 72 is formed on a side surface of the upper cup 8. The fuel flows through the fuel inlet hole 72 into the reservoir portion 71. The filter 9, which is folded in the middle, is provided in the reservoir portion 71. The fuel flowing to be stored in the reservoir portion 71 is sucked by the fuel pump 5 through the filter 9.

The pump assembly 6 includes the electric motor 4, the fuel pump 5, the pressure regulator 21, and the check valve 22, which are integrally housed within a shell case 23 made of steel. The outlet cover 24 and an inlet cover 25 are respectively fixed to the ends of the cylindrical shell case 23 by caulking. The outlet cover 24 is made of a synthetic resin and is mounted to one end of the shell case 23.

A brush holder portion 27 for holding a brush 26 of the electric motor 4 is provided to the outlet cover 24. Specifically, the outlet cover 24 serves as a cover of the shell case 23 and also as the brush holder of the electric motor 4. The pressure regulator 21 and the check valve 22 are provided inside the outlet cover 24. The check valve 22 is provided to the fuel discharge port 13. An end of the check valve 22 is connected to the communication pipe 14 in communication therewith. An end of the pressure regulator 21 is open in the fuel tank 2.

The inlet cover 25 is formed by die-casting of aluminum and is mounted to another end side of the shell case 23. A fuel inlet portion 28 is provided in a projecting manner on the lowed end side of the inlet cover 25. The filter 9 is provided to the outer side of the fuel inlet portion 28. The filter 9 is formed to have an approximately rectangular shape as a whole. The filter 9 is provided in the case portion 7*a* of the flange unit 7 while being folded in a C-like shape.

The electric motor 4 is a DC motor with a brush. The shell case 23 also serves as a yoke of the electric motor 4. A plurality of permanent magnets 31 are fixed onto an inner circumferential surface of the shell case 23. An armature 32 is rotatably provided on the inner side of the permanent magnets 31. The armature 32 includes: a core 34 including a plurality of axially extending slots 33; and a winding 35 wound around the core 34 so as to pass along the slots 33. The armature 32 is fixed to a rotating shaft 36. The armature 32 is rotatably supported between a bearing portion 37 provided to the outlet cover 24 and a bearing 38 provided to a pump case 61. Above the armature 32 in FIG. 1, a commutator 40 is provided. The commutator 40 is fixed to the rotating shaft 36. The brush 26 is in abutment against the commutator 40 in a radial direction.

The pressure regulator 21 includes: an armature 43 including a ball (steel ball) 42; and a valve spring 44. The armature 43 and the valve spring 44 are accommodated in a regulator accommodating portion 41 formed inside the outlet cover 24. The regulator accommodating portion 41 has a minor-diameter portion 45 on the upstream side (lower side in FIG. 1) and a major-diameter portion 46 on the downstream side. A valve surface is formed at the boundary between the minor-diameter portion 45 and the major-diameter portion 46. The valve surface is obtained by plastically deforming an edge of the boundary portion between the minor-diameter portion 45 and the major-diameter portion 46 with punching. When the ball 42 comes into close contact with the valve surface, the pressure regulator 21 is placed in a valve-closed state. A retainer 47 is pressed into and fixed to an end of the major-diameter portion 46 on the downstream side. The retainer 47 is formed to have an approximately ring-like shape. One end of the valve spring 44 is in abutment against the upstream side (lower end surface) of the retainer 47.

A coil spring is used as the valve spring 44. Another end of the valve spring 44 is in abutment against a spring holder 48 of the armature 43. The ball 42 is normally in pressure contact with the valve surface by a biasing force of the valve spring 44 (valve-closed state). When a fluid pressure is applied from the minor-diameter portion 45 side to become larger than the biasing force of the valve spring 44, the ball 42 is moved upward to generate a gap between the valve surface and the ball 42. As a result, the pressure regulator 21 is placed in a valve-open state. Specifically, when a fuel pressure in the shell case 23 exceeds a predetermined regulating pressure, the fuel pressure is applied to the armature 43 to move upward the armature 43. As a result, an excessive fuel is returned to the fuel tank 2. When the fluid pressure is lowered and the biasing force of the valve spring 44 becomes larger than the fluid pressure, the ball 42 is moved downward by the biasing force of the valve spring 44 to come into abutment against the valve surface. When the ball 42 abuts against the valve surface, the minor-diameter portion 45 is closed. As a result, the pressure regulator 21 is placed in the valve-closed state.

The check valve 22 includes: a valve 53 having a semi-spherical sealing portion 52 at one end; and a valve spring 54. The valve 53 and the valve spring 54 are accommodated in a check valve accommodating portion 51 formed inside the outlet cover 24. Similarly to the regulator accommodating portion 41, the check valve accommodating portion 51 includes a minor-diameter portion 55 on the upstream side and a major-diameter portion 56 on the downstream side. A tapered surface 57 is formed in a boundary portion between the minor-diameter portion 55 and the major-diameter portion 56. When the sealing portion 52 comes into abutment against the tapered surface 57, the check valve 22 is placed in a valve-closed state. A valve guide 58 is fixed by caulking to an end of the major-diameter portion 56 on the downstream side. One end of the valve spring 54 is in abutment against the upstream side (lower end surface) of the valve guide 58.

A coil spring is used even for the valve spring 54. Another end of the valve spring 54 is in abutment against the valve 53. The sealing portion 52 of the valve 53 is normally in pressure contact with the tapered surface 57 by the biasing force of the valve spring 54 (valve-closed state). When the fluid pressure is applied from the minor-diameter portion 55 side to become larger than the biasing force of the valve spring 54, the valve 53 is moved upward to generate a gap between the tapered surface 57 and the sealing portion 52. As a result, the check valve 22 is placed in a valve-open state. When the fuel pump 5 is operated to cause the fuel to be supplied from the minor-diameter portion 55 side, the check valve 22 is opened by the pressure of the fuel to supply the fuel to the fuel pipe 3. When the fuel pump 5 is stopped to lower the fluid pressure, the biasing force of the valve spring 54 becomes larger than the fluid pressure. As a result, the valve 53 is moved downward by the biasing force of the valve spring 54. When the valve 53 is moved downward, the sealing portion 52 comes into abutment against the tapered surface 57 to close the minor-diameter portion 55. As a result, the check valve 22 is placed in the valve-closed state. When the check valve 22 is closed, the fuel can be prevented from reversely flowing from the fuel pipe 3 to the fuel pump 5.

The fuel pump 5 is a non-positive displacement type regenerative pump and includes the pump case 61 and an impeller 62. On the lower end side of the pump case 61, a cylindrical impeller accommodating portion 63 is provided in a concave manner. The impeller 62 connected to the rotating shaft 36 of the electric motor 4 is provided in the impeller accommodating portion 63. A D-shaped portion 36*a* is formed on the rotating shaft 36. The impeller 62 is mounted to the D-shaped portion 36*a* to rotate integrally with the rotating shaft 36. In an area of the impeller 62 on the side closer to the outer periphery thereof, a plurality of pump chambers 64 are provided along a circumferential direction.

The fuel inlet portion 28 is provided to the inlet cover 25 so as to correspond to the pump chambers 64. As described above, in a pre-stage of the fuel inlet portion 28, the filter 9 is located. A communication hole 65 is provided on the upper end side of the impeller accommodating portion 63 so as to correspond to the pump chambers 64. The communication hole 65 is open in the shell case 23 to be faced thereto. When the electric motor 4 is driven to operate the rotating shaft 36, the impeller 62 is rotated in the fuel pump 5. With the rotation of the impeller 62, the fuel is sucked into the pump chambers 64 from the fuel inlet portion 28. The fuel supplied to the pump chambers 64 is delivered through the communication hole 65 into the shell case 23 by the rotation of the impeller 62. The fuel in the shell case 23 is supplied to the fuel pipe 3 through the check valve 22.

The fuel supply device 1 functions as follows. First, when the electric motor 4 is driven to operate the fuel pump 5, the fuel in the fuel tank 2 passes through the fuel inlet hole 72 to flow into the reservoir portion 71. The fuel in the reservoir portion 71 is sucked into the fuel inlet portion 28 through the filter 9. In the fuel pump 5, the impeller 62 rotates with the rotating shaft 36. With the rotation of the impeller 62, the fuel is sucked from the fuel inlet portion 28 into the pump chambers 64. The fuel supplied to the pump chambers 64 is delivered to the shell case 23 by the rotation of the impeller 62. The fuel in the shell case 23 is supplied from the fuel discharge port 13 to the fuel pipe 3 through the check valve 22.

When the fuel pressure exceeds the predetermined regulating pressure along with the pumping operation, the pressure regulator 21 is placed in the valve-open state. When the pressure regulator 21 is opened, the fuel in the shell case 23 is returned to the fuel tank 2. As a result, the pressure of the fuel supplied to the fuel pipe 3 side is appropriately regulated. As described above, the fuel pipe 3 is connected to the fuel injection valve of the engine. The fuel sucked from the fuel tank 2 by the fuel supply device 1 is supplied to the fuel injection valve through the fuel pipe 3.

It is apparent that the present invention is not limited to the embodiments described above and various changes are possible without departing from the scope of the present invention.

In the above-mentioned embodiment, the fuel supply device used for the fuel obtained by mixing alcohol and gasoline in an arbitrary proportion has been described. However, the present invention is also applicable to a fuel supply device used only for gasoline. Moreover, the number of terminals (five in this embodiment) in the terminal connection portion 81 is merely an example, and therefore, the number of terminals is not particularly limited. Further, the relation of the male terminals and the female terminals is not limited to that described above. The male terminals may be provided on the harness 17 side, whereas the female terminals may be provided on the side of the terminal attachment portions 82.

On the other hand, although the example where the fuel supply device according to the present invention is used for the two-wheel motor vehicles has been described in the above-mentioned embodiments, the use of the fuel supply device according to the present invention is not limited thereto. The fuel supply device according to the present invention can also be used as a fuel supply device for various vehicles such as four-wheel motor vehicles. Moreover, the structure of the present invention is applicable not only to the fuel pump but also to a pump which supplies a liquid such as water or a chemical liquid or a gas such as air. Further, the structures of the electric motor 4 and the fuel pump 5 are not particularly limited. For example, the number of poles, the number of slots, the shape of the impeller, and the like can be appropriately set.

What is claimed is:

1. A fuel supply device, comprising:

an electric pump device configured to be driven by an electric motor; and a case member for housing and retaining the electric pump device therein, wherein:

the case member comprises a plurality of terminal attachment portions, in which a plurality of power-feeding terminals to be connected to feeder wirings of the electric motor are individually accommodated while being electrically insulated from each other; and the plurality of terminal attachment portions are arranged alternately in two rows so that one of the plurality of terminal attachment portions in one of the two rows is located between the terminal attachment portions which are adjacent to each other in another row.

2. A fuel supply device according to claim 1, wherein:

each of the plurality of terminal attachment portions is formed to have a cylindrical shape so that the plurality of terminal attachment portions may respectively accommodate the plurality of power-feeding terminals therein; and a line segment obtained by connecting centers of openings of the plurality of terminal attachment portions adjacent to one another is a polygonal line.

3. A fuel supply device according to claim 1, wherein:

each of the plurality of power-feeding terminals is formed by a terminal member made of a metal;

the terminal member has one end which is connected to each of the feeder wirings and another end which is connected to a coupler electrically connected to an external power supply; and the terminal member includes two types of components including a component provided for the terminal attachment portion arranged in the one row of the plurality of terminal attachment portions arranged alternately in the two rows and a component provided for the terminal attachment portion arranged in the another row of the plurality of terminal attachment portions arranged alternately in the two rows.

4. A fuel supply device according to claim 2, wherein:

each of the plurality of power-feeding terminals is formed by a terminal member made of a metal;

the terminal member has one end which is connected to each of the feeder wirings and another end which is connected to a coupler electrically connected to an external power supply; and the terminal member includes two types of components including a component provided for the terminal attachment portion arranged in the one row of the plurality of terminal attachment portions arranged alternately in the two rows and a component provided for the terminal attachment portion arranged in the another row of the plurality of terminal attachment portions arranged alternately in the two rows.

5. A fuel supply device according to claim 1, wherein:

each of the plurality of terminal attachment portions is provided with a slit which allows an opening of each of the plurality of terminal attachment portions to be elastically enlarged, at a fore-end thereof; and an outer edge of the opening is elastically enlarged owing to the slit when a rubber grommet provided to a portion at which each of the plurality of power-feeding terminals and the corresponding one of the feeder wirings are coupled is inserted through the opening.

6. A fuel supply device according to claim 1, wherein:

a portion at which each of the plurality of power-feeding terminals and the corresponding one of the feeder wirings are coupled is provided with a rubber grommet; and the rubber grommet includes a seal lip portion having a plurality of concave portions and a plurality of convex portions which are successively arranged on an outer periphery thereof, while a point angle $\theta$ of each of the plurality of convex portions is formed to be obtuse.

7. A fuel supply device according to claim 6, wherein the rubber grommet is formed of a fluororubber.

8. A fuel supply device according to claim 1, wherein the fuel supply device is used for a fuel obtained by mixing alcohol and gasoline in an arbitrary proportion.

* * * * *